United States Patent [19]

Martel et al.

[11] Patent Number: 5,056,273

[45] Date of Patent: Oct. 15, 1991

[54] ABRASIVE DEVICE WITH REPLACEABLE MULTI-PACK INSERTS

[76] Inventors: Richard I. Martel, P.O. Box 1011, Marathon, Fla. 33050; Gerald G. Brown, P.O. Box 127, Lummi Island, Wash. 98262

[21] Appl. No.: 421,846

[22] Filed: Oct. 16, 1989

[51] Int. Cl.[5] ..... B24D 15/00

[52] U.S. Cl. ..... 51/392; 51/393; 51/406

[58] Field of Search ..... 51/392, 406, 358, 393, 51/391, 181 R; 15/208, 209 R, 231, 232, 22 R, 143 R, 159 R, 171, 176.1, 176.4

[56] References Cited

U.S. PATENT DOCUMENTS 1,896,253 2/1933 Smith ..... 51/392

3,167,799 2/1965 McKinley ..... 15/176.4

*Primary Examiner*—M. Rachuba

*Attorney, Agent, or Firm*—Cassidy, Vance & Tarleton

[57] ABSTRACT

A hand-held, hand-operable, abrasive tool (10) comprising: i) a handle (11) having a trapezoidally shaped insert mounting slot or aperture (12); ii) a rigid replaceable insert (14, 14', 14'') having a work engaging face (18, 18',18'') of desired shape and size and a trapezoidally shaped mounting pedestal (19) adapted to be snugly received within, and frictionally retained by, the trapezoidally shaped slot or aperture (12) in handle (11); and iii), a multi-pack (15, 15', 15'') of adhesively edge-bonded abrasive sheets (16) which can be adhesively affixed to the work engaging face (18, 18', 18'') of the rigid replaceable insert (14, 14', 14'') in conforming face-to-face relation; and, wherein an expended abrasive sheet (16) can be discarded merely by peeling that sheet off the multi-pack (15, 15', 15'') to expose the fresh, unused, underlying abrasive sheet (16), and inserts (14, 14', 14'') can be easily replaced by merely applying pressure to the dome-shaped crown (20) on the pedestal (19) mounted in the handle (11) to eject the same.

7 Claims, 1 Drawing Sheet

ABRASIVE DEVICE WITH REPLACEABLE MULTI-PACK INSERTS

BACKGROUND OF THE INVENTION

1. Technical Field

The present invention relates generally to hand-held and hand-operated abrasive devices; and, more particularly, to a hand tool including a multi-pack of replaceable abrasive block inserts each having a multi-pack of abrasive sheets of selected grit—e.g., one abrasive block insert might include a multi-pack of 100 grit abrasive sheets; another might include a multi-pack of 150 grit abrasive sheets; a third might include a multi-pack of 200 grit abrasive sheets; etc.—or other selectable abrasive characteristics so as to permit the user to: i) select a particular insert having abrasive sheets of a desired grit and/or shape: ii) insert the selected insert into operative engagement with the hand-held tool; and iii), dispose of expended abrasive sheets on the selected insert merely by peeling such expended sheets off of the multi-pack on that insert so as to expose the underlying, fresh, unused abrasive sheet of the same grit and/or shape and/or other abrasive characteristic. As used herein, the term "abrasive sheet" is used in a broad non-limiting sense and may include a wide range of conventional flexible abrasive sheets such, merely by way of example, as sandpaper, emery cloth, etc.

More specifically, the present invention provides a plurality of replaceable abrasive inserts each of which serves to support a multi-pack of abrasive sheets of selected like abrasive characteristics, which sheets are "edge-bonded" together with the bottommost sheet being adhesively bonded in face-to-face relation with a rigid abrasive block insert capable of being inserted into a hand-held tool and frictionally retained in place until such time as the user elects to eject the rigid abrasive block insert and replace it with another insert also including a multi-pack of abrasive sheets, but having a different abrasive characteristic—e.g., a different grit size, a different abrasive material, etc.—or with an insert having a different shape, yet including a conformably shaped multi-pack of abrasive sheets.

2. Background Art

Hobbyists, furniture finishers and other individuals engaged in highly detailed finishing and/or refinishing projects have long required a small hand-held tool having an instantly replenishable supply of small abrasive sheets with selectable desired abrasive characteristics in terms of grit size, abrasive material, shape, etc., Yet, which does not need to be dismantled each time that the abrasive sheet in use is expended. Indeed, the prior art is replete with patents disclosing various approaches to the problem--approaches which have met with varying degrees of success, but all of which are believed to inherently possess one or more practical disadvantages.

For example, Johnston U.S. Pat. No. 3,842,549 discloses a sandpaper holder block having a head portion capable of receiving and clamping in place any selected one of a plurality of anvil inserts each having a desired shape. A single sheet of sandpaper is clamped in place in the holder block in surrounding relationship to the selected anvil insert. However, when that sheet of sandpaper has been expended, it is necessary to dismantle the tool in order to replace the expended sheet with a new unused sheet.

Several prior art patents disclose various types of hand-held sanding tools capable of mechanically clamping in place a plurality of discrete sandpaper sheets wherein the uppermost sheet can simply be torn off or otherwise removed when its abrasive characteristics have been depleted. For example, May U.S. Pat. No. 932,879, issued almost 80 years ago, discloses a sandpaper plane in which a plurality of sandpaper sheets are clamped to a hand-held tool along their opposed longitudinal edges in such a manner that expended sheets can be removed one-by-one after use without dismantling the tool. A somewhat similar device is disclosed in Pritikin U.S. Pat. No. 2,840,959 wherein the plurality of sheets are clamped in place at their opposite ends with expended sheets being individually removeable to expose the underlying unused sheet merely by releasing the clamping pressure. In U.S. Pat. No. 2,415,367 issued to Pavlovic, a plurality of sandpaper sheets or strips are folded about an elongate tool body and retained in place by projecting pins formed in the tool body. Retz U.S. Pat. No. 1,841,208 suggests stapling a plurality of abrasive sheets to a flat wood base; while Ingram U.S. Pat. No. 2,585,655 provides a spring loaded pressure tray mounted on a tool handle, with the tray having a plurality of folded over edge tabs for mechanically retaining a multi-pack of sandpaper sheets in place.

A number of prior patents have suggested the use of multiple sheets of abrasive material which are adhesively bonded together in such a manner that expended sheets can be peeled away from underlying unused sheets. Thus, Dirkes U.S. Pat. No. 1,822,856 discloses an abrasive pad consisting of a plurality of abrasive impregnated rubber layers separated by paper or fabric sheets and vulcanized together. U.S. Pat. No. 1,896,253 issued to Smith, 2d, discloses a device similar to that in the aforesaid Retz U.S. Pat. No. 1,841,208 except that the multi-pack abrasive sheets include a plurality of aligned through edge perforations which are filled with adhesive so as to separably secure the sheets together and to the base member. In Larson U.S. Pat. No. 2,485,295 and Thompson U.S. Pat. No. 2,626,489, adhesive material is placed on the reverse or non-abrasive side of each sheet for adhesively, yet separably, bonding that sheet to the abrasive side of the underlying sheet.

In Feuerstein U.S. Pat. No. 2,018,611, the patentee suggests positioning a plurality of equidimensional sandpaper sheets, preferably of different grits, on opposite sides of a central rigid block; and, retaining the entire assembly as a unitary package by wrapping an adhesive strip or tape about the peripheral edges of the assembly.

Finally, Field U.S. Pat. No. 2,826,014 discloses an abrasive tool in which a single sheet of sandpaper is adhesively bonded to a conical head.

In general, however, the foregoing patents have failed to provide a simple, effective and economical hand tool in which the user can select any given insert having a work face of desired shape and bearing thereon multi-pack abrasive sheets whose abrasive work surfaces are exposed one-by-one and which are devoid of foreign substances which tend to denegrate the abrasive characteristics of the sheet, yet which do not have to be dismantled when a given abrasive sheet is expended. Thus, neither Johnston nor Field contemplate or suggest a tool which is capable of use with multi-packs of abrasive material. While May and Pritikin do contemplate usage of multiple sheets of abrasive material, they are employed in single purpose sanding blocks which are not capable of utilizing different shaped inserts; and, in Pritikin the device must be disassembled to remove expended sheets. Pavlovic requires a complex tool/pin arrangement to hold the sheets in place, while both Retz and Ingram disclose devices incorporating exposed metal retainers overlying the work faces of the sanding device. In Dirkes, Smith 2d, Larson and Thompson, the exposed abrasive surfaces of each abrasive sheet will be contaminated with adhesive material from the overlying sheet; while in Feuerstein, the peripheral adhesive tape used to maintain the unitary packaged assembly will inherently interfere with the sanding operation as more and more expended abrasive sheets are removed.

SUMMARY OF THE INVENTION

The present invention overcomes all of the foregoing disadvantages by providing a simple, compact, rugged, hand-held abrasive device consisting of: i) a handle having a slightly tapered through opening formed therein—viz., an opening which gets progressively smaller from the bottom surface toward the upper surface of the handle; ii) a replaceable rigid insert having a slightly tapered upstanding pedestal adapted to fit within and frictionally engage the handle opening, and a planar or other desireably shaped work engaging base portion; and iii), a plurality of abrasive sheets which are adhesively edge-bonded with the reverse non-abrasive side of the lowermost abrasive sheet in each multi-pack being adhesively bonded in face-to-face relationship with the undersurface of the work engaging base portion of the rigid replaceable insert. Because the separable individual discrete sheets of abrasive material are adhesively "edge-bonded", there is no need for separate metal fastening members which might otherwise interrupt the abrasive work engaging surface of the tool; and, each of the expended abrasive sheets can be easily peeled off and discarded without any significant danger of leaving adhesive residue on the abrasive surface of the underlying abrasive sheet.

DESCRIPTION OF THE DRAWING

These and other objects and advantages of the present invention will become more readily apparent upon reading the following Detailed Description and upon reference to the attached drawing, in which.

Figure 1:
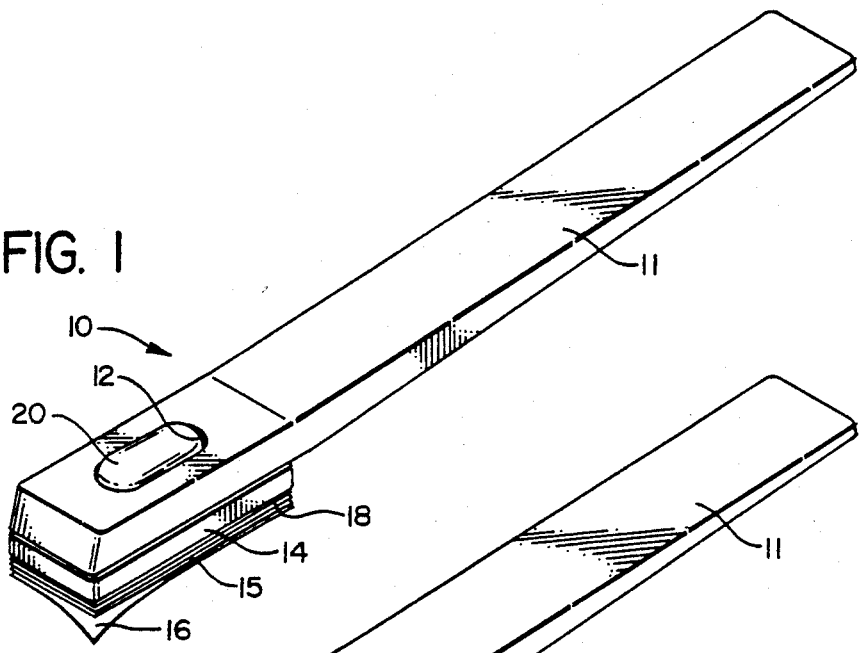
FIG. 1 is an isometric view of a hand-held, hand-operated, abrasive tool embodying features of the present invention.

While the invention is susceptible of various modifications and alternative forms, specific embodiments thereof have been shown by way of example in the drawing and will herein be described in detail. It should be understood, however, that it is not intended to limit the invention to the particular forms disclosed but, on the contrary, the intention is to cover all modifications, equivalents and alternatives falling within the spirit and scope of the invention as expressed in the appended claims.

DETAILED DESCRIPTION

Turning now to the drawing, a hand-held hand-operable, abrasive tool embodying features of the present invention has been generally depicted at 10 in FIG. 1. Thus, as here shown, the tool 10 consists of: i) a handle 11 having a through slot or aperture 12 at its operable end; ii) a rigid replaceable insert 14 separably mounted within the slot or aperture 12; and, iii) a multi-pack 15 of adhesively edge-bonded abrasive sheets 16 mounted on a work engaging face 18 formed on the rigid replaceable insert 14. By a "multi-pack of edge-bonded abrasive sheets", it is meant simply that a plurality of abrasive sheets 16 of like abrasive characteristics—for example, all the sheets 16 in a given multi-pack will preferably be of the same grit size; and, all will preferably be formed of the same abrasive material, be it sandpaper, emery cloth or some other type of conventional, flexible, abrasive sheet—are placed in stacked relation, one upon the other, with their abrasive surfaces facing in a common direction; and, at least certain, and preferably all, of the exposed peripheral aligned edges of the sheets are then coated with a suitable, preferably quick drying, adhesive in the same manner as conventionally employed to edge-bond invoices and other business papers or tablets of paper and similar writing materials; except, that in the present invention the adhesive coating is applied to all peripheral exposed edges rather than just along a single edge of a stack of rectangular sheets.

In accordance with one of the important aspects of the present invention, and as best illustrated by reference to FIGS. 2 and 3 conjointly, it will be observed that the rigid replaceable insert 14 includes a work engaging base portion, which is here shown as a flat rectangular work engaging base portion 18, and an upstanding, centrally disposed, pedestal 19 dimensioned to be snugly received within the slot or aperture 12 in handle 11 and frictionally retained thereby. In keeping with this aspect of the invention, the pedestal 19 is preferably of slightly trapezoidal shape when viewed in either axial or transverse cross section, including sloping sidewalls which preferably converge at increasing distances from the base portion 18 of the insert 14. Preferably the corners of the pedestal 19 are slightly rounded so as to eliminate any sharp edges, while the crown 20 of the pedestal 19 is also slightly rounded or dome-shaped so as to ensure comfort of use and handling as well as to facilitate insertin of the pedestal 19 into the slot or aperture 12. Similarly, the slot or aperture 12 formed in handle 11 also incorporates a trapezoidal shape complemental to that of the pedestal 19 on insert 14, thereby enabling ease of positioning of the insert pedestal 19 into the slot or aperture 12 and forcing of the insert into a position within the slot or aperture 12 wherein the insert 14 is snugly mounted on the handle 11 and frictionally retained in place. Nevertheless, when the user wishes to replace the insert 14 with another insert having either a differently shaped work engaging base 18 or a multi-pack 15 of abrasive sheets 16 having differing abrasive characteristics, it is merely necessary for the user to place a finger or thumb on the dome-shaped crown 20 of the insert 14 when the components are assembled as shown in FIGS. 1 and 3 and press downwardly with respect to the handle 11, thereby ejecting the insert 14 from the tool 10.

Figure 2:
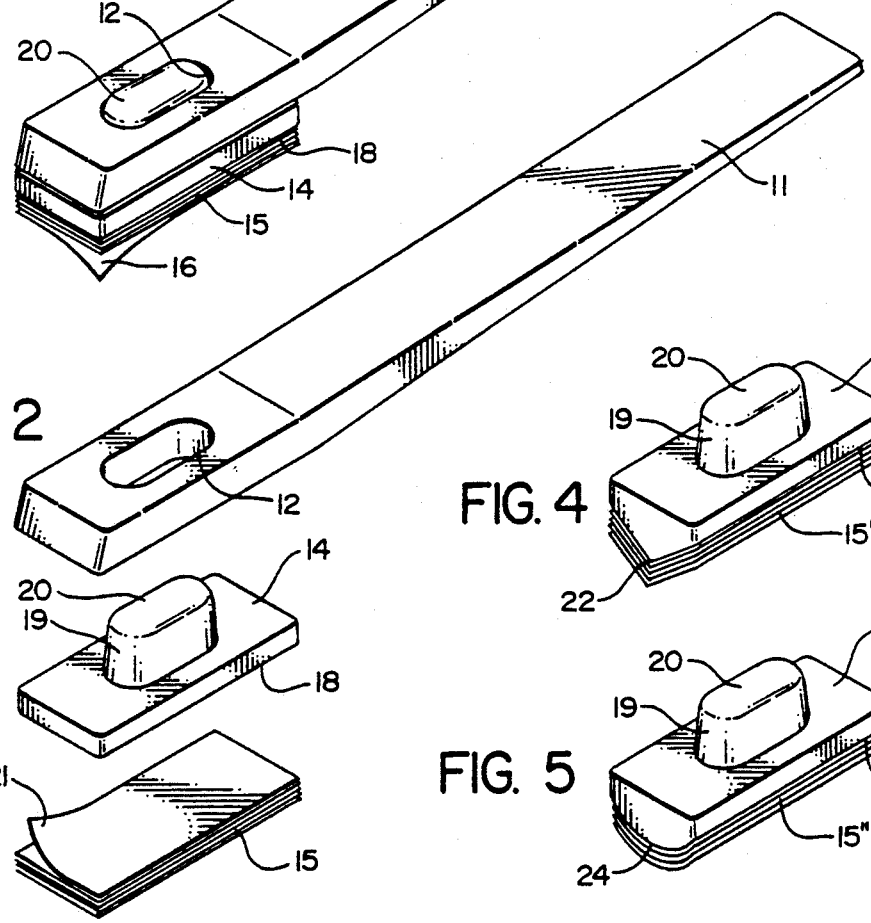
FIG. 2 is an isometric view of the hand-held tool depicted in FIG. 1, here illustrating the three basic components of the tool in exploded form.
Figure 3:
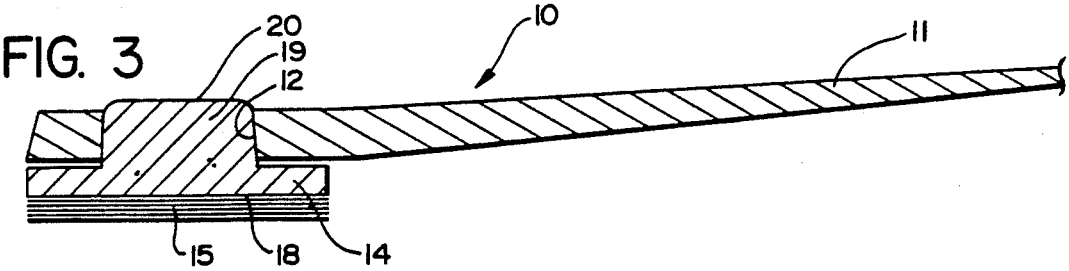
FIG. 3 is a fragmentary, vertical, sectional view taken substantially along the line 3—3 in FIG. 1.

As can be appreciated upon inspection of FIGS. 2 and 3, the non-abrasive surface of the bottom abrasive sheet 16 (actually, the uppermost sheet as viewed in the drawing) is placed in face-to-face engagement with the work engaging face 18 on insert 14 and adhesively bonded in place by any suitable adhesive means, not shown. For example, in carrying out the invention the multi-pack 15 of adhesively edge-bonded abrasive sheets would preferably include an adhesive coating on the exposed non-abrasive side of the lowermost sheet (the uppermost sheet as viewed in FIG. 2) with a protective layer 21 of waxed paper or the like disposed thereon. Consequently, when the user wishes to attach the multi-pack 15 of abrasive sheets to the work engaging face 18 on insert 14—either initially or when the last abrasive sheet has been expended and removed from the insert 14—it is merely necessary to peel off the protective sheet 21 and adhesively bond the multi-pack 15 to the work engaging face 18 on insert 14 by application of suitable pressure.

In use, when the uppermost exposed abrasive sheet 16 (i.e., the lowermost sheet shown in FIG. 1) has been used to the point where the abrasive substance has been depleted and no longer has the desired utility, the user need merely grasp the corner of that expended sheet 16 and peel it off the multi-pack 15 so as to expose the fresh, unused abrasive surface of the underlying abrasive sheet 16.

Figure 4:
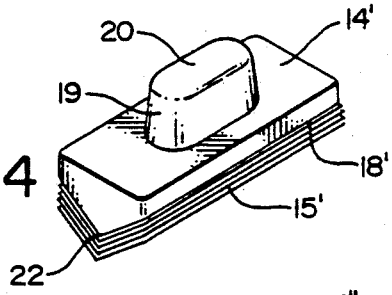
FIG. 4 is an isometric view of a somewhat modified replaceable insert here having a V-shaped configuration and a multi-pack of edge-bonded V-shaped abrasive sheets bonded thereto; and, FIG. 5 is an isometric view of yet another modified replaceable insert in which the work engaging body portion of the insert has a rounded configuration and the multi-pack of edge-bonded abrasive sheets are adhesively bonded thereto in conforming shape.
Figure 5:
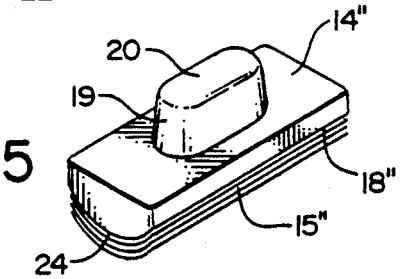

Those skilled in the art will appreciate that hobbyists and other individuals engaged in fine detail finishing and/or refinishing work will often desire to work with an abrasive tool having other than a flat planar work engaging face; and, indeed, a given finishing project may require that the user shift alternately between two or more differently shaped tools during different phases of the abrading operation. The present invention readily lends itself to this particular requirement. Thus, the hand-held, hand-operable tool 10 of the present invention is preferably provided with a plurality of differently shaped, rigid, replaceable inserts such, merely by way of example, as the particularly shaped inserts depicted in FIGS. 4 and 5. More specifically, a slightly modified rigid replaceable insert 14′ has been shown in FIG. 4 which is identical in construction, operation and use to that shown at 14 in FIGS. 1 through 3 except that in this instance, the work engaging face 18′ is triangular or "V-shaped" in cross section, defining: i) an elongate sharp edge 22 extending axially the length of the insert; and ii), angularly related sloping work engaging faces 18′. Consistent with this modified construction, the multi-pack 15′ of adhesively edge-bonded abrasive sheets is folded along a line coincident with the sharp axial edge 22 of the insert 14′ into a conformable configuration of triangular or "V-shape".

Alternatively, the rigid replaceable insert may readily be fabricated in a wide range of other shapes and sizes. Thus, in FIG. 5 the work engaging face 18″ of insert 14″ includes a convex, curved or rounded configuration as indicated at 24; and, the multi-pack 15″ of adhesively edge-bonded abrasive sheets is again conformably shaped.

Those skilled in the art will readily appreciate that the work engaging face(s) of the tool can take a wide range of other shapes and sizes which need not be further illustrated and/or described herein in detail. For example, rather than being convexly shaped as indicated at 24 in FIG. 5, the work engaging face can be concave (not shown). In any of the foregoing instances, however, the pedestal 19 retains the same shape without change so as to permit insertion and frictional retention within the slot or aperture 12 formed in the handle 11 (FIGS. 1–3).

Thus, there has herein been described a simple, yet highly effective and versatile, hand-held, hand-operable abrasive tool, together with unique multi-packs of adhesively edge-bonded abrasive sheets and a variety of different shaped and sized rigid replaceable inserts, permitting the user to freely alternate between inserts of a given type and/or abrasive sheets of a given characteristic, yet wherein expended abrasive sheets can simply be peeled off the multi-pack and discarded without having to dismantle the tool.

We claim:

1. A hand-held, hand-operable, abrasive tool comprising, in combination:

a) an elongate handle having a top surface and a bottom surface, said handle having a tapered through aperture formed at one end thereof wherein the aperture is progressively smaller at increased distances from said bottom surface of said handle;

b) a rigid replaceable insert, said insert having a work engaging base portion and an upstanding tapered pedestal adapted to snugly fit into said through aperture in said handle and to be frictionally retained therein until affirmatively ejected by the user by applying pressure to the upper end of said pedestal; and, c) a multi-pack of separate, independent, discrete abrasive sheets having lie abrasive characteristics, said multi-pack of separate, independent, discrete abrasive sheets consisting solely of a unitary assemblage of a plurality of separate, independent, imperforate sheets disposed in face-to-face abutting relation with their peripheral edges aligned and with their abrasive surfaces facing in a common direction, said plurality of abrasive sheets being separably held together in a unitary multi-pack by means of adhesive applied to the exposed peripheral edges of said sheets and with said multi-pack being devoid of bonding means extending through said sheets and like separable fastening elements used to maintain said sheets as a unitary assemblage, and with the non-abrasive surface of the bottommost one of said multi-pack of abrasive sheets being adhesively bonded to said work engaging base portion of said rigid replaceable insert in face-to-face conforming relation therewith;

whereby, when the outermost exposed one of said abrasive sheets is expended, the user need merely peel such exposed sheet off said multi-pack so as to expose the underlying unused abrasive sheet and when the user desires to modify said hand-held tool to employ abrasive material having a different shape and/or different abrasive characteristics, it is merely necessary to eject the selected one of said rigid replaceable inserts and substitute therefore a different rigid replaceable insert having the desired shape and/or abrasive characteristics.

2. A hand-held, hand-operable, abrasive tool as set forth in claim 1 wherein said work engaging base portion of said rigid replaceable insert includes a planar work engaging face and said multi-pack of adhesively edge-bonded abrasive sheets comprising a multi-pack of flat, planar abrasive sheets shaped conformably to said work engaging base portion.

3. A hand-held, hand-operable, abrasive tool as set forth in claim 1 wherein said work engaging base portion of said rigid replaceable insert includes a curved work engaging face and said multi-pack of adhesively edge-bonded abrasive sheets is curved to conform to the curved configuration of said work engaging face.

4. A hand-held, hand-operable, abrasive tool as set forth in claim 1 wherein said work engaging base portion of said rigid replaceable insert is convex and said multi-pack of adhesively edge-bonded abrasive sheets is convexly shaped so as to conform to the convex configuration of said work engaging face.

5. A hand-held, hand-operable, abrasive tool as set forth in claim 1 wherein said work engaging base portion of said rigid replaceable insert includes angularly related sloping sides defining a sharp elongate work engaging edge and said multi-pack of adhesively edge-bonded abrasive sheets are folded along a line coincident with said sharp edge on said work engaging face and includes angularly relating sloping side portions so that said multi-pack conforms in shape to the shape of said work engaging face.

6. A multi-pack of separate, independent, discrete abrasive sheets having like abrasive characteristics for use with a hand-held, hand-operable, abrasive tool, said multi-pack of separate, independent, discrete abrasive sheets consisting solely of a unitary assemblage of a plurality of separate, independent, imperforate abrasive sheets disposed in face-to-face abutting relation with their peripheral edges aligned and with their abrasive surfaces facing in a common direction, said plurality of abrasive sheets being separably held together in a unitary multi-pack by means of adhesive applied to the exposed peripheral edges of said sheets and with said multi-pack being devoid of bonding means extending through said sheets and like separable fastening elements used to maintain said sheets as a unitary assemblage, whereby when the outermost exposed one of said abrasive sheets is expended, the user need merely peel such exposed sheet off said multi-pack so as to expose the underlying unused abrasive sheet in a condition devoid of adhesive on its exposed abrasive surface.

7. A multi-pack of separate, independent, discrete abrasive sheets having like abrasive characteristics as set forth in claim 6 wherein the exposed non-abrasive surface of the bottommost abrasive sheet is coated with an adhesive material and a removable protective layer is applied thereon.

* * * * *